US009065203B2

(12) United States Patent
Davies

(10) Patent No.: US 9,065,203 B2
(45) Date of Patent: Jun. 23, 2015

(54) APPARATUSES AND METHODS FOR SECURING A CONNECTION OF AN ELECTRICAL CONNECTION ASSEMBLY

(71) Applicant: Craig Davies, Centerville, UT (US)

(72) Inventor: Craig Davies, Centerville, UT (US)

( * ) Notice: Subject to any disclaimer, the term of this patent is extended or adjusted under 35 U.S.C. 154(b) by 128 days.

(21) Appl. No.: 13/964,954

(22) Filed: Aug. 12, 2013

(65) Prior Publication Data

US 2015/0044896 A1 Feb. 12, 2015

(51) Int. Cl.

| | |
|---|---|
| ***H01R 33/00*** | (2006.01) |
| ***H01R 13/62*** | (2006.01) |
| ***H01R 43/20*** | (2006.01) |

(52) U.S. Cl.

CPC ..... *H01R 13/62* (2013.01); *H01R 43/20* (2013.01)

(58) Field of Classification Search

CPC ..... H01R 13/62; H01R 43/20

USPC ..... 439/345, 350, 682, 915

See application file for complete search history.

(56) References Cited

U.S. PATENT DOCUMENTS

| | | | | |
|---|---|---|---|---|
| 1,921,447 | A * | 8/1933 | Barnett | 439/447 |
| 4,200,350 | A * | 4/1980 | Zimmerman, Jr. | 439/357 |
| 5,190,475 | A * | 3/1993 | Dickens | 439/588 |
| 5,383,794 | A * | 1/1995 | Davis et al. | 439/352 |
| 5,886,294 | A * | 3/1999 | Scrimpshire et al. | 174/359 |

* cited by examiner

*Primary Examiner* — Khiem Nguyen

(57) ABSTRACT

A shim for securing an electrical connection of an electrical connection assembly. The shim includes a cylindrical sleeve with opposite proximal and distal ends. The cylindrical sleeve runs from a proximal end of the shim to a distal end of the shim. An interior portion of the cylindrical sleeve is defined by an opening from the proximal end of the shim to the distal end of the shim. The opening allows a plug of the electrical connector assembly to be inserted within the opening of the cylindrical sleeve while the shim is inserted into a socket of the electrical connector assembly to hold the plug securely in the socket of the electrical connection assembly.

11 Claims, 6 Drawing Sheets

APPARATUSES AND METHODS FOR SECURING A CONNECTION OF AN ELECTRICAL CONNECTION ASSEMBLY

TECHNICAL FIELD

The present disclosure relates generally to shims, and more particularly, to apparatuses and methods for securely connecting a plug within a socket of an electrical connection assembly.

BACKGROUND

An electrical connector assembly may include a cable of sheathed electrical wires that terminates on both ends at plugs, a first plug being removably received a first socket mounted on a tractor and the second plug being removably received at a second socket on a trailer. Similarly, a cable with sockets and plugs may join the trailer with an additional trailer. Each socket may include a plurality of male pins that mate with a plurality of female terminals on the plug. The male pins and the female terminals are typically soldered or welded to the metallic ends of the wires in the sheathed cable, and the wires in the tractor or trailer are likewise connected.

The plugs, sockets, and metallic connections, even when the plug and the socket are connected to one another, may be exposed to the environment and therefore susceptible to corrosion and other degrading processes. For example, degradation of the plugs, sockets, and/or metallic connections may be caused by vibrations that are induced by operation of the tractor trailer. Over time, the fit of the plug in the socket may degrade to the point that a lose connection may result in loss of one or more electrical connections between the metallic connections. As a result, benefits may be realized by providing systems and methods for ensuring a secure connection between the plugs, sockets, and metallic connections of a tractor trailer electrical connection assembly.

SUMMARY

One aspect of the present disclosure relates to a shim and an electrical connection assembly. The shim includes a cylindrical sleeve with opposite proximal and distal ends. The cylindrical sleeve runs from a proximal end of the shim to a distal end of the shim. An interior portion of the cylindrical sleeve is defined by an opening from the proximal end of the shim to the distal end of the shim. The opening allows a plug of the electrical connector assembly to be inserted within the opening of the cylindrical sleeve while the shim is inserted into a socket of the electrical connector assembly to hold the plug securely in the socket of the electrical connection assembly.

In one embodiment, the cylindrical sleeve may be defined by a gap running a length of the cylindrical sleeve from the proximal end of the cylindrical sleeve to the distal end of the cylindrical sleeve. The gap may allow a diameter of the cylindrical sleeve to expand and contract to fit around a periphery of the plug of the electrical assembly. The shim may include a flange extending around at least a portion of a periphery of the cylindrical sleeve. The flange may provide a grip to allow a user to grasp and position the shim in relation to the electrical connection assembly. The shim may include a tapered annular support extending around at least a portion of a periphery of the cylindrical sleeve. The tapered annular support may provide support between the cylindrical sleeve and the flange. In some embodiments, the flange and the tapered annular support are positioned towards the distal end of the shim.

In one embodiment, the proximal end of shim inserts into the socket of the electrical connection assembly. The opening further may allow the plug of the electrical connector assembly to make an electrical connection with the socket of the electrical connector assembly while the plug is inserted within the opening of the cylindrical sleeve and while the shim is inserted into the socket of the electrical connector assembly. In some eases, at least a portion of the cylindrical sleeve is tapered from a portion towards the distal end of the shim to a portion towards the proximal end of the shim. At least a portion of the shim may include a polymer and/or a metal.

A further aspect of the present disclosure relates to a method of securing an electrical connection of an electrical connector assembly. A shim may be provided for the electrical connection assembly, the shim comprising a cylindrical sleeve. A plug of the electrical connection assembly may be inserted inside an opening of the cylindrical sleeve. The opening of the cylindrical sleeve may extend from a proximal end of the shim to a distal end of the shim. The shim may be inserted into a socket of the electrical connection assembly with the plug of the electrical connection assembly inserted within the shim.

The foregoing and other features, utilities, and advantages of the invention will be apparent from the following detailed description of the invention with reference to the accompanying drawings.

BRIEF DESCRIPTION OF THE DRAWINGS

The accompanying drawings illustrate various embodiments of the present disclosure and are a part of the specification. The illustrated embodiments are merely examples of the present disclosure and do not limit the scope of the invention.

Throughout the drawings, identical reference numbers designate similar, but not necessarily identical, elements.

DETAILED DESCRIPTION

The apparatuses and methods disclosed herein are generally related to shims, and more particularly related to securing a connection of an electrical connection assembly. Electrical connector assemblies are devices that electrically communicate a tractor with a trailer or electrically communicate adjacent trailers for operation of a variety of electrical systems, including brake lights, running lights, turn signal lights, and anti-lock braking systems. Because the tractor-trailer is a modular assembly, wherein the trailer can be viewed as an interchangeable component, tractor-trailer electrical connector assemblies adhere to the Society of Automotive Engineers (SAE) standard J560. While all electrical connector assemblies follow SAE standards, particular electrical connector assemblies can differ from one another in features outside the J560 specification.

Figure 1:
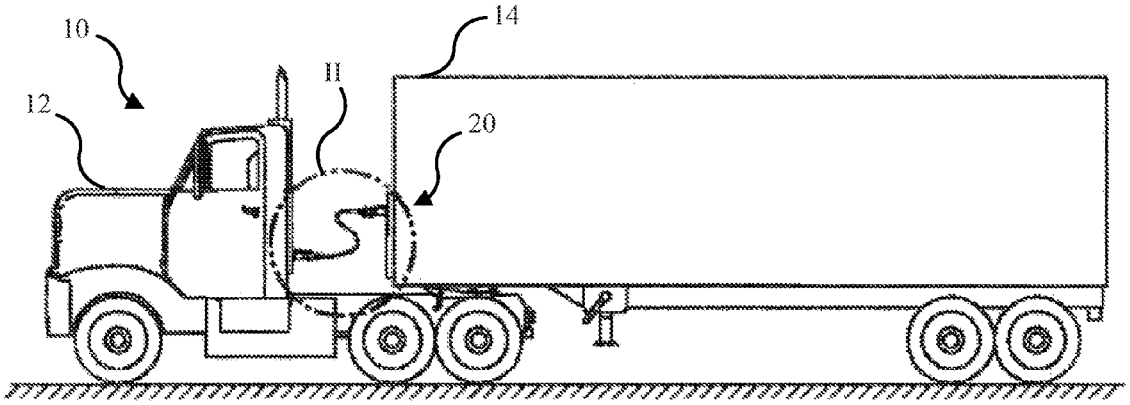
FIG. 1 is a side view of a tractor-trailer equipped with electrical connector assembly according to one embodiment of the invention.
Figure 2:
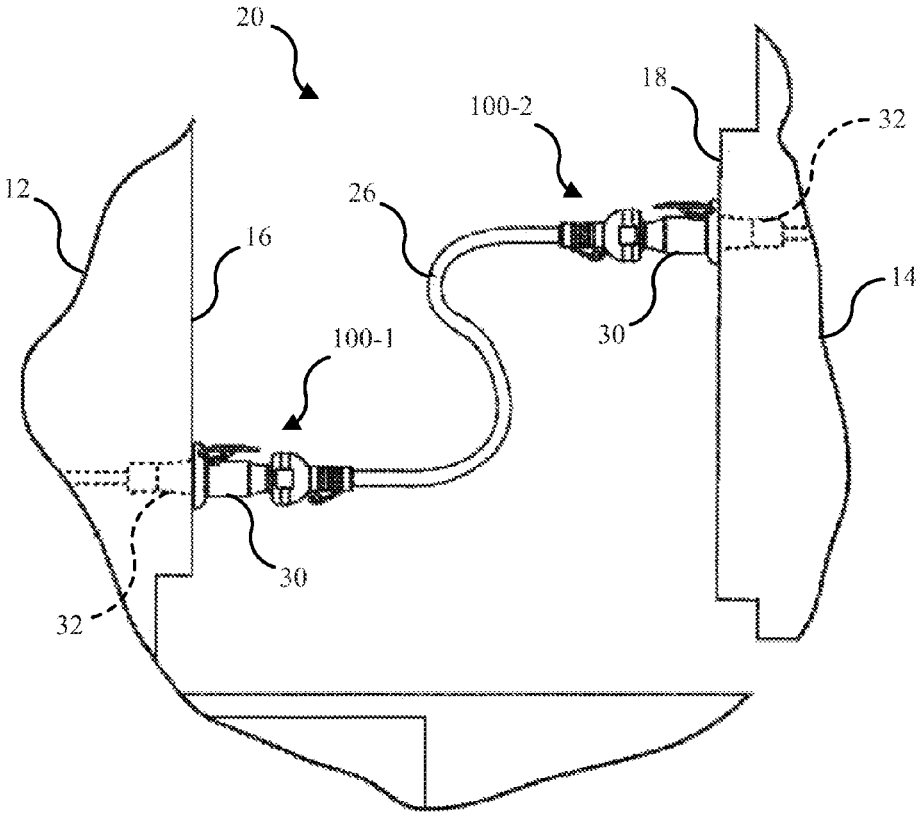
FIG. 2 is another view of the region labeled II of FIG. 1 showing the electrical connector assembly electrically coupling a tractor with a trailer.

Referring now to the figures, FIG. 1 illustrates an exemplary, conventional tractor-trailer 10 comprising a tractor 12 electrically coupled to a trailer 14 by an electrical connector assembly 20 according to one embodiment of the invention. As shown in FIG. 2, which is an enlarged view of the area labeled II in FIG. 1, the tractor 12 includes a rear wall 16 that supports a tractor portion 100-1 of the electrical connector assembly 20, and, similarly, the trailer 14 has a front wall 18 that supports a trailer portion 100-2 of the electrical connector assembly 20. The tractor portion 100-1 and the trailer portion 100-2 are connected by a cable 26 of sheathed electrical wires to electrically couple the tractor 12 to the trailer 14. The cable 26 terminates at a pair of plugs 30, which are removably received by a corresponding socket 32 mounted to the corresponding rear wall 16 of the tractor 12 or the front wall 18 of the trailer 14. While the electrical connector assembly 20 is shown and described herein as electrically coupling the tractor 12 to the trailer 14, it is within the scope of the invention for the electrical connector assembly 20 to couple adjacent trailers, in which case, the electrical connector assembly 20 would comprise two trailer portions 100-2, one on one trailer and another on the adjacent trailer, rather than a tractor portion 100-1 and a trailer portion 100-2.

Figure 3:
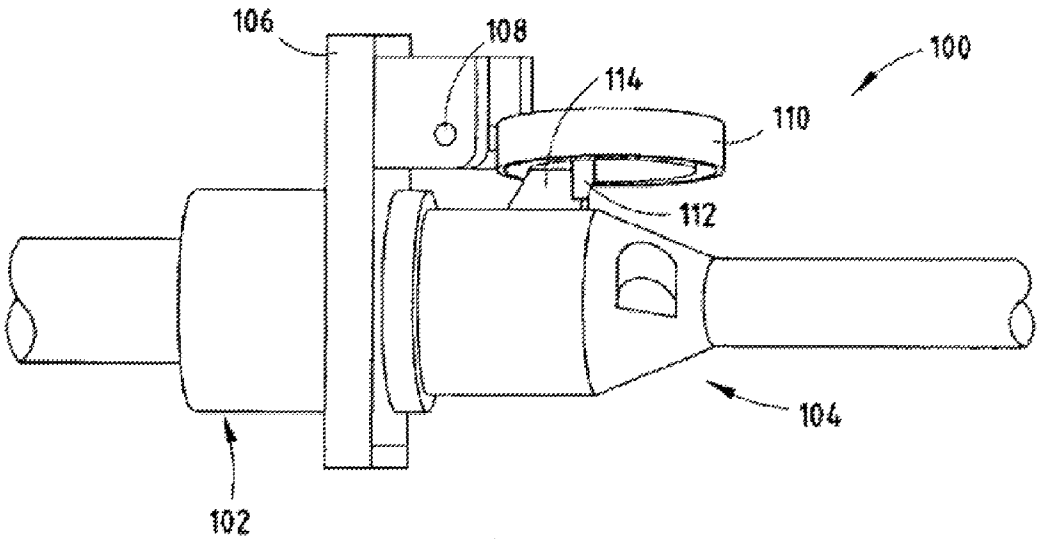
FIG. 3 is a side view of an electrical connector assembly, according to one embodiment of the present invention, in a mated condition.
Figure 4:
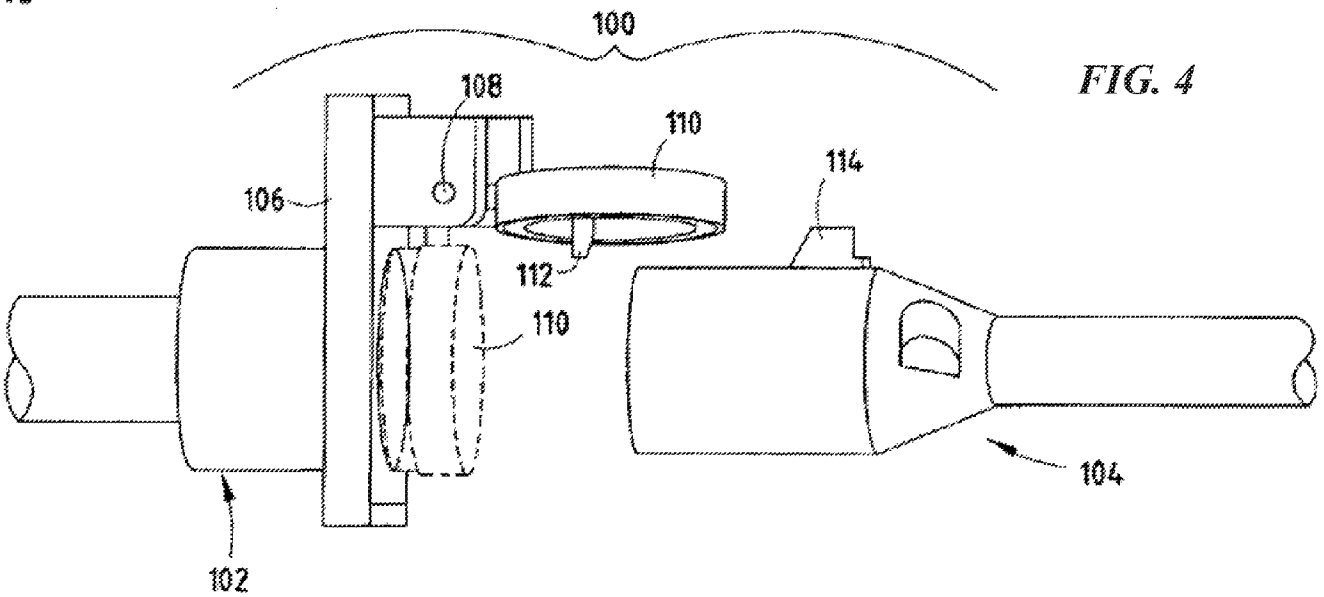
FIG. 4 is a side view of the electrical connector assembly of FIG. 3 in an unmated condition.

FIGS. 3 and 4 depict a portion of an electrical connector assembly 100, according to one embodiment of the present invention. The portion of the electrical connector assembly 100 may be one example of the tractor portion 100-1 and/or trailer portion 100-2 of the electrical connection assembly 20 of FIG. 1 and/or 2. As depicted, FIG. 3 shows a side view of an electrical connector assembly, according to one embodiment of the present invention, in a mated condition. FIG. 4 shows a side view of the electrical connector assembly of FIG. 3 in an unmated condition.

The socket 102 of the electrical connector 100 may include a mounting baseplate 106. The baseplate 106 may include a hinging assembly 108, which attaches a spring-biased door 110 to the baseplate 106. An inner surface of the door 110 may include a latching tab 112 extending from the inner surface of the door 110. A plug 104 may include an indexing key 114 that extends from its outer shell. The latching tab 112 may engage the key 114 when the plug 102 and socket 104 are in a mated condition.

Figure 5:
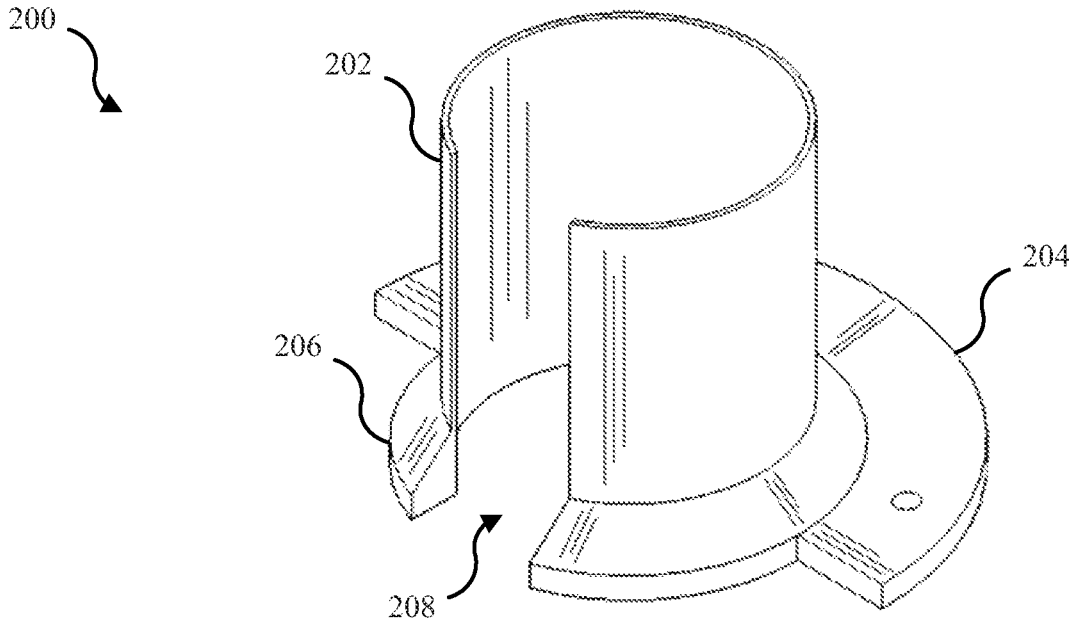
FIG. 5 is a perspective view of a shim according to one embodiment of the invention.
Figure 6:
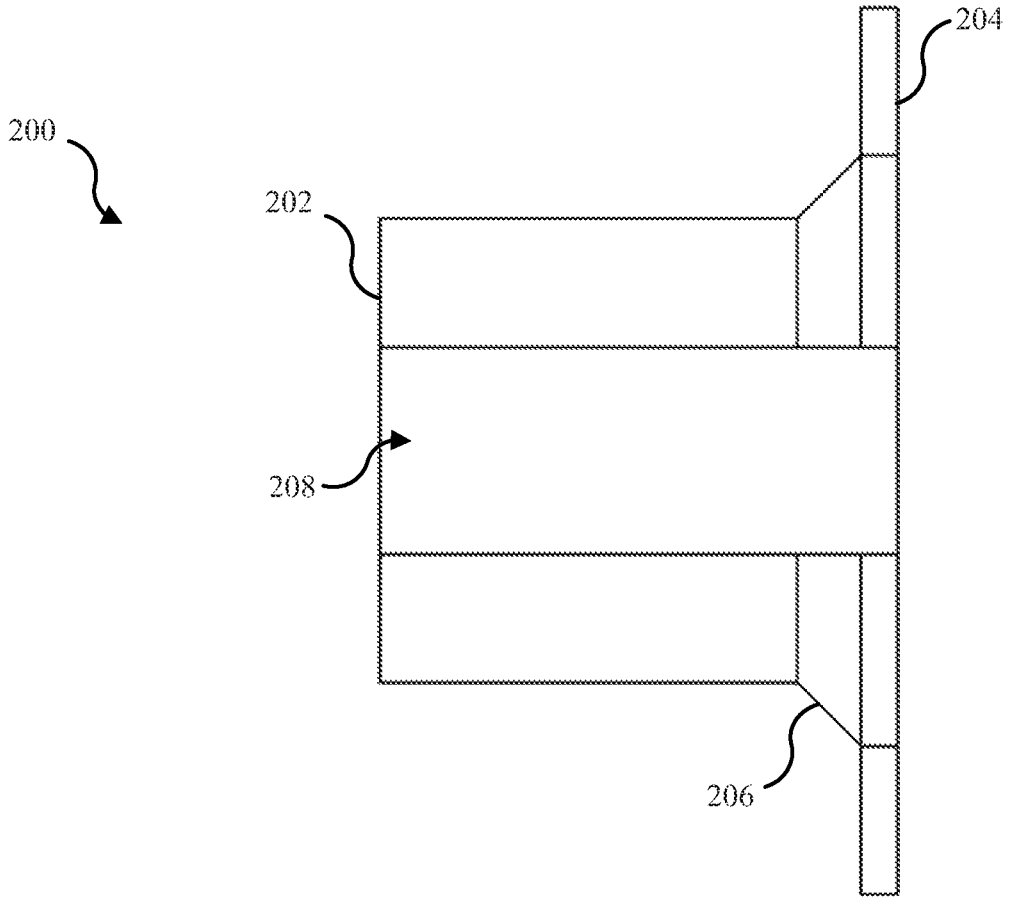
FIG. 6 is a top view of the shim of FIG. 5.
Figure 7:
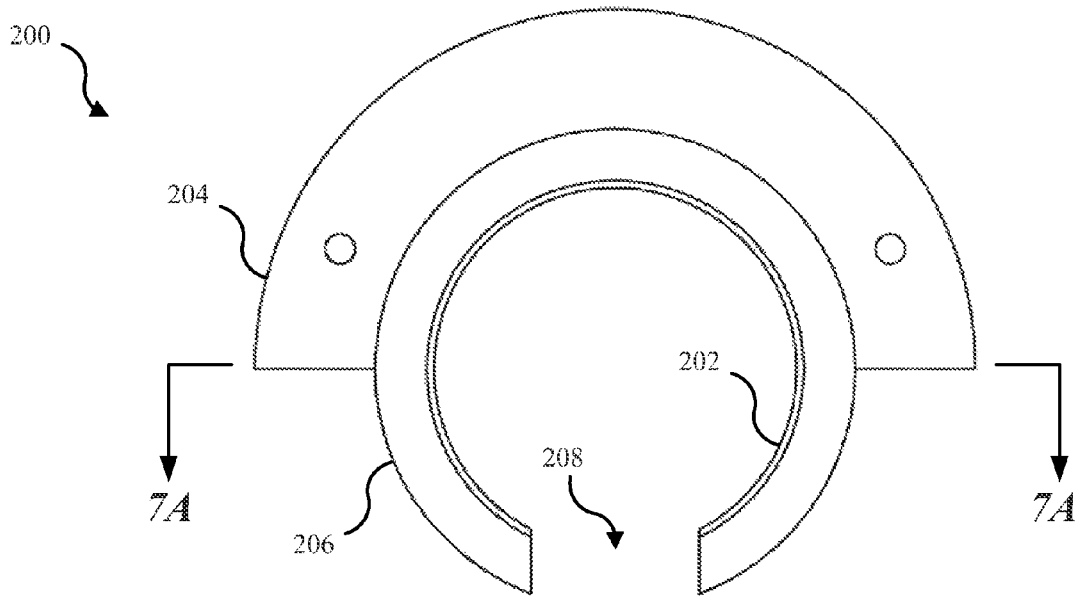
FIG. 7 is a side view of the shim of FIG. 5.
Figure 7A:
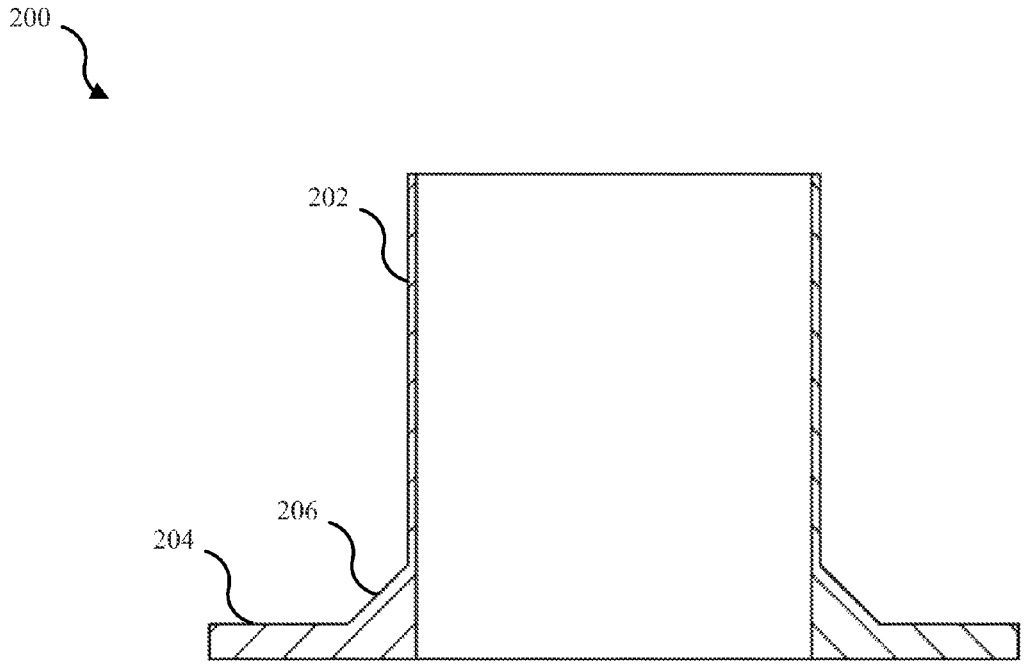
FIG. 7A is a cross-sectional view of the shim of FIG. 7 taken along cross-section indicators 7A-7A.

FIG. 5 is a perspective view of a shim 200 according to one embodiment of the invention. According to one embodiment of the invention, FIG. 6 is a top view of the shim 200 of FIG. 5, FIG. 7 is a side view of the shim 200 of FIG. 5, and FIG. 7A is a cross-sectional view of the shim of FIG. 7 taken along cross-section indicators 7A-7A. As depicted in one or more of FIGS. 5-7A, the shim 200 may include a cylindrical sleeve 202. The cylindrical sleeve 202 may include opposite proximal and distal ends. The cylindrical sleeve 202 may run from a proximal end of the shim 200 to a distal end of the shim 200. In one embodiment, the proximal end of shim 200 may insert into a socket of an electrical connection assembly.

An interior portion of the cylindrical sleeve may be defined by an opening or cylindrical cavity from the proximal end of the shim 200 to the distal end of the shim 200. The opening may allow a plug of the electrical connector assembly 20 to be inserted within the opening of the cylindrical sleeve 202 white the shim 200 is inserted into a socket of the electrical connector assembly 20, thus holding or wedging the plug securely in the socket of the electrical connection assembly. In some cases, a socket and/or plug may include one or more ledges, grooves, and/or notches. Thus, in some embodiments, the cylindrical sleeve 202 may include one or more corresponding ledges, grooves, and or notches running at least a portion of the length of the cylindrical sleeve 202 to better fit the cylindrical sleeve 202 on a socket and/or plug. In some embodiments, the opening in the cylindrical sleeve 202 may allow a plug of the electrical connector assembly to make an electrical connection with the socket of the electrical connector assembly while the plug is inserted within the opening of the cylindrical sleeve and white the shim is inserted into the socket of the electrical connector assembly.

In one embodiment, the cylindrical sleeve 202 may be defined by a gap 208 running a length of the cylindrical sleeve 202 from the proximal end of the cylindrical sleeve 202 to the distal end of the cylindrical sleeve 202. The gap may allow an effective diameter and/or circumference of the cylindrical sleeve 202 to expand and contract in order to allow the shim 200 to fit snugly around and/or adapt to a periphery of a plug of the electrical assembly 20. The shim may include a flange 204 extending around at least a portion of a periphery of the cylindrical sleeve 202. The flange 204 may provide a grip to allow a user to grasp and position the shim 200 in relation to the electrical connection assembly.

In some cases, shim 200 may include a tapered annular support 206 extending around at least a portion of a periphery of the cylindrical sleeve 202. The tapered annular support 206 may provide support between the cylindrical sleeve 202 and the flange 204. In some embodiments, the flange 204 and tapered annular support 206 are positioned towards the distal end of the shim 200. In one embodiment, at least a portion of the cylindrical sleeve 202 may be tapered from a relatively thicker portion towards the distal end of the shim 200 to a relatively thinner portion towards the proximal end of the shim 200. At least a portion of the shim 200 may include a polymer and/or a metal. According to one embodiment of the present invention, the shim 200 may be injection molded from a plastic material.

Figure 8:
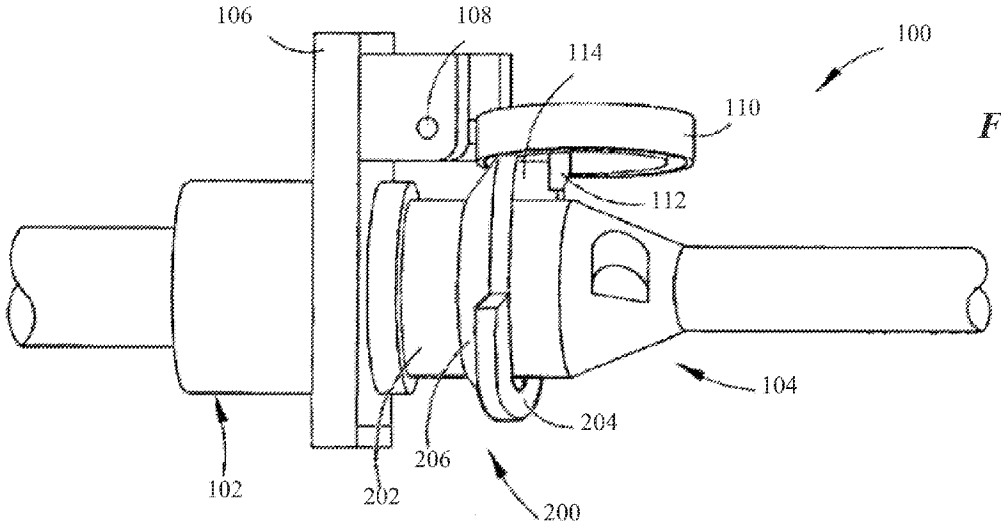
FIG. 8 is a side view of an electrical connector assembly in a mated condition with the shim inserted in the socket, according to one embodiment of the present invention.
Figure 9:
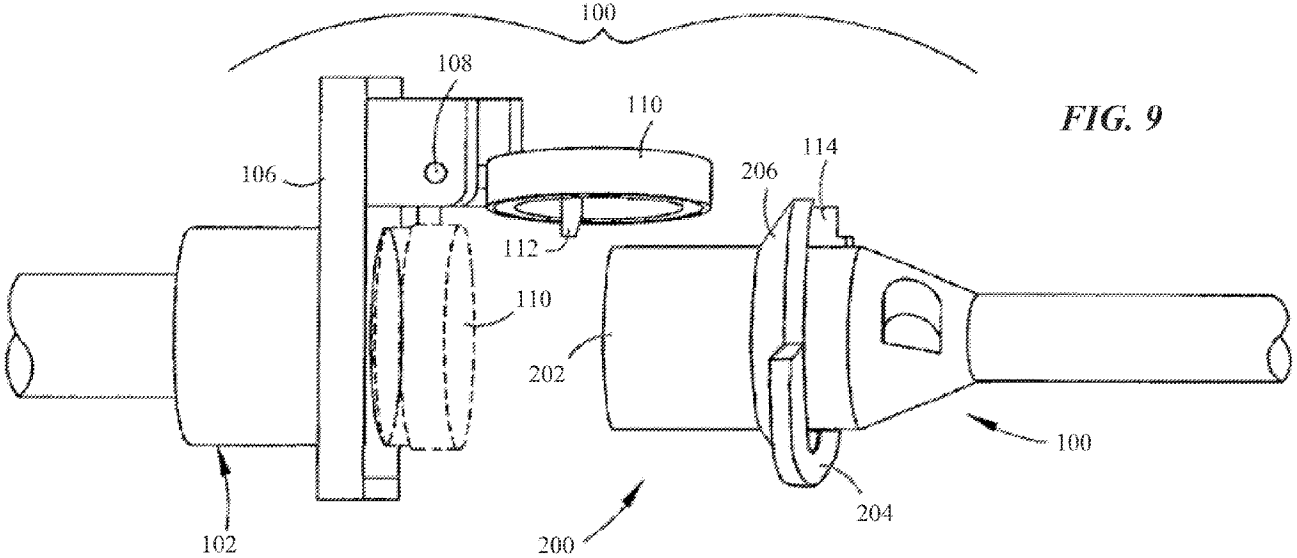
FIG. 9 is a side view of the electrical connector assembly of FIG. 9 in an unmated condition, with the shim positioned on the plug of the electrical connector assembly.

FIGS. 8 and 9 depict a portion of an electrical connector assembly 100, according to one embodiment of the present invention. The portion of the electrical connector assembly 100 may be one example of the tractor portion 100-1 and/or trailer portion 100-2 of the electrical connection assembly 20 of FIG. 1 and/or 2. As depicted, FIG. 8 shows a side view of an electrical connector assembly 100 in a mated condition with shim 200 inserted in the socket, according to one embodiment of the present invention.

With the plug and socket mated, the shim 200 may be inserted into the socket 102 with the plug 104 inserted into the opening of the cylindrical sleeve 202 of the shim 200. The gap 208 of shim 200 may allow the shim to be placed over the plug 104 without the shim 200 interfering with the latching tab 112 and/or indexing key 114. FIG. 9 shows a side view of the electrical connector assembly 100 of FIG. 8 in an unmated condition, with the shim 200 positioned on the plug of the electrical connector assembly. Alternatively, shim 200 may be positioned in socket 102 with the electrical connector assembly 100 in an unmated condition.

Figure 10:
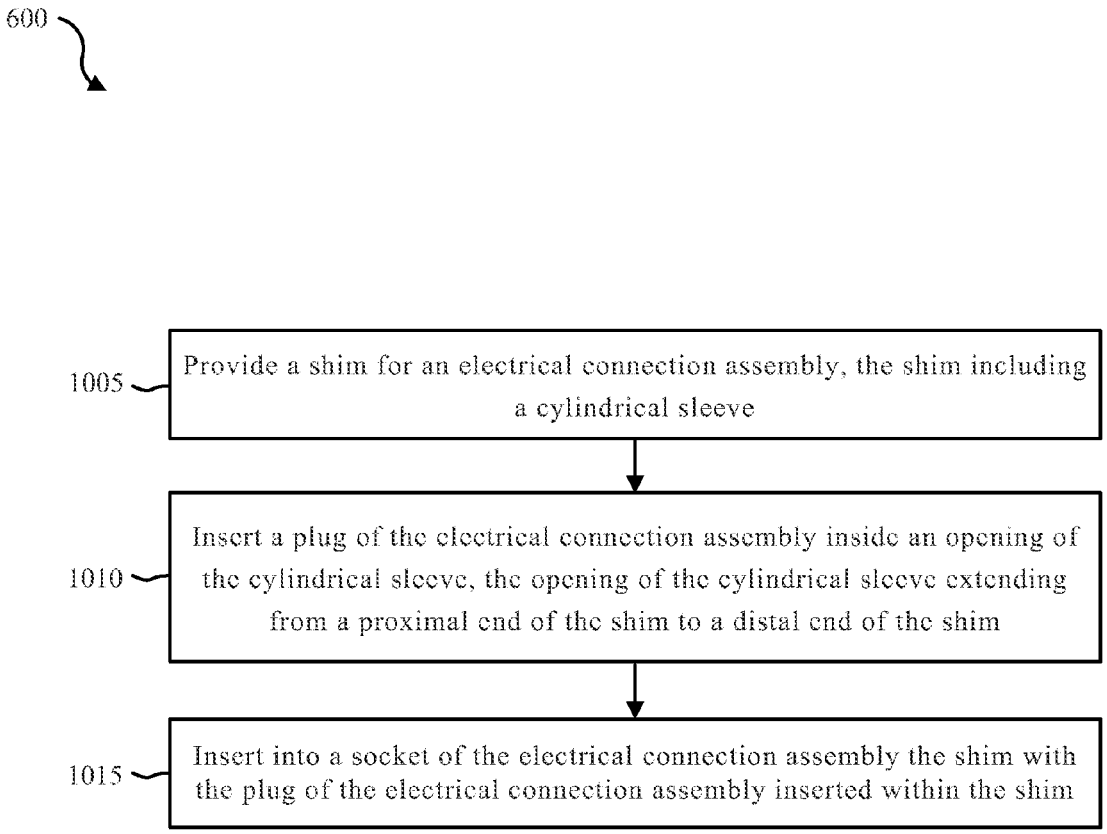
FIG. 10 is a flowchart showing steps of a method for assembling a secure electrical connection using the shim of FIGS. 5-8.

FIG. 10 is a flowchart showing steps of a method for assembling a secure electrical connection using the shim of FIGS. 5-7A. At block 1005, a shim may be provided for the electrical connection assembly, the shim comprising a cylindrical sleeve. At block 1010, a plug of the electrical connection assembly may be inserted inside an opening of the cylindrical sleeve. The opening of the cylindrical sleeve may extend from a proximal end of the shim to a distal end of the shim. At block 1015, the shim may be inserted into a socket of the electrical connection assembly with the plug of the electrical connection assembly inserted within the shim. Alternatively, the shim may be inserted first into a socket of the electrical connection assembly, and a plug may then be inserted into the shim.

As used in this specification and the appended claims, the terms "engage" and "engagable" are used broadly to mean interlock, mesh, or contact between two structures or devices. The words "including" and "having," as well as their derivatives, as used in the specification, including the claims, have the same meaning as the word "comprising."

The preceding description has been presented only to illustrate and describe exemplary embodiments of the invention. It is not intended to be exhaustive or to limit the invention to any precise form disclosed. Many modifications and variations are possible in light of the above teaching. It is intended that the scope of the invention be defined by the following claims.

What is claimed is:

1. A shim for an electrical connector assembly, the shim comprising:

a cylindrical sleeve with opposite proximal and distal ends, the cylindrical sleeve running from a proximal end of the shim to a distal end of the shim; and an interior portion of the cylindrical sleeve being defined by an opening from the proximal end of the shim to the distal end of the shim, the opening allowing a plug of the electrical connector assembly to be inserted within the opening of the cylindrical sleeve while the shim is inserted into a socket of the electrical connector assembly, the shim wedging the plug securely in the socket of the electrical connector assembly.

2. The shim of claim 1, the cylindrical sleeve being defined by a gap running a length of the cylindrical sleeve from the proximal end of the cylindrical sleeve to the distal end of the cylindrical sleeve, the gap allowing a diameter of the cylindrical sleeve to expand and contract to fit around a periphery of the plug of the electrical assembly.

3. The shim of claim 1, further comprising a flange extending around at least a portion of a periphery of the cylindrical sleeve, the flange providing a grip to allow a user to grasp and position the shim in relation to the electrical connection assembly.

4. The shim of claim 3, further comprising a tapered annular support extending around at least a portion of a periphery of the cylindrical sleeve, the tapered annular support to provide support between the cylindrical sleeve and the flange.

5. The shim of claim 4, wherein the flange and the tapered annular support are positioned towards the distal end of the shim.

6. The shim of claim 1, wherein the proximal end of shim inserts into the socket of the electrical connector assembly.

7. The shim of claim 1, the opening further allowing the plug of the electrical connector assembly to make an electrical connection with the socket of the electrical connector assembly while the plug is inserted within the opening of the cylindrical sleeve and while the shim is inserted into the socket of the electrical connector assembly.

8. The shim of claim 1, wherein at least a portion of the cylindrical sleeve is tapered from a portion towards the distal end of the shim to a portion towards the proximal end of the shim.

9. The shim of claim 1, wherein at least a portion of the shim comprises a polymer.

10. The shim of claim 1, wherein at least a portion of the shim comprises a metal.

11. A method of securing an electrical connection of an electrical connector assembly, comprising:

providing a shim for the electrical connector assembly, the shim comprising a cylindrical sleeve;

inserting a plug of the electrical connector assembly inside an opening of the cylindrical sleeve, the opening of the cylindrical sleeve extending from a proximal end of the shim to a distal end of the shim; and inserting into a socket of the electrical connector assembly the shim with the plug of the electrical connector assembly inserted within the shim.

* * * * *